US011255630B2

(12) United States Patent
Denning

(10) Patent No.: US 11,255,630 B2
(45) Date of Patent: Feb. 22, 2022

(54) ARROW FLETCHING DEVICE, METHOD, AND SYSTEM

(71) Applicant: John Gerald Denning, Sheboygan, WI (US)

(72) Inventor: John Gerald Denning, Sheboygan, WI (US)

( * ) Notice: Subject to any disclaimer, the term of this patent is extended or adjusted under 35 U.S.C. 154(b) by 259 days.

(21) Appl. No.: 16/374,498

(22) Filed: Apr. 3, 2019

(65) Prior Publication Data

US 2020/0318931 A1 Oct. 8, 2020

(51) Int. Cl.

| | |
|---|---|
| ***F41B 5/14*** | (2006.01) |
| ***B25B 1/20*** | (2006.01) |
| ***F42B 6/06*** | (2006.01) |
| ***B27M 3/22*** | (2006.01) |

(52) U.S. Cl.

CPC ..... *F41B 5/1446* (2013.01); *B27M 3/22* (2013.01); *F42B 6/06* (2013.01)

(58) Field of Classification Search

CPC ..... F41B 5/1446; B27M 3/22

See application file for complete search history.

(56) References Cited

U.S. PATENT DOCUMENTS

| | | | | |
|---|---|---|---|---|
| 2,276,574 A * | 3/1942 | Haag | D06F 45/04 68/263 A |
| 2,884,034 A * | 4/1959 | Portinga | F41B 5/1446 269/38 |
| 4,927,478 A * | 5/1990 | Erickson | F41B 5/1446 156/185 |
| 7,074,143 B2 * | 7/2006 | Czemske | F42B 6/06 473/586 |
| 8,286,953 B2 * | 10/2012 | Barnes | B25B 11/02 269/38 |
| 8,333,369 B2 * | 12/2012 | Kozlik | F42B 6/04 269/9 |
| 8,752,813 B2 * | 6/2014 | Meyer | F41B 5/1446 269/38 |
| 9,823,038 B2 * | 11/2017 | Hollars | F41B 5/14 |

* cited by examiner

*Primary Examiner* — John A Ricci
(74) *Attorney, Agent, or Firm* — CERES Patent & Technology, LLC; Mandy L. Tran, Esq.

(57) ABSTRACT

The present inventive subject matter relates to a device, method and system for preparing and adhering fletching to an arrow. The invention comprising a method and tool for preparation of fletched tape and a method and tool for adhering said fletched tape to an arrow shaft. The tool of this invention enables manual fletching of arrows in precise personalized manner.

10 Claims, 9 Drawing Sheets

ARROW FLETCHING DEVICE, METHOD, AND SYSTEM

CROSS REFERENCES

This application is a non-provisional utility patent application claiming benefit of priority to and incorporating by reference in full the provisional patent application No. 62/658,528, filed on Apr. 16, 2019, in accordance with 35 U.S.C. § 119.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark office, patent file or records, but otherwise reserves all copyright rights whatsoever.

BACKGROUND OF THE INVENTION

Field of the Invention

The present inventive subject matter relates to a device, method and system for preparing and adhering fletching to an arrow.

Background

Archery is a fine tuned sport that involves the interplay of many mechanical components and precise human handling. The tool and the user, each an extension of the other, will perform up to their capacities. The tools of archery basically comprise a bow and an arrow component. These two basic components are very carefully crafted and constructed from smaller parts, each of which must further meet precision standards.

Artisans of this sport often enjoy crafting their own tools, personalized to their own manner or style of performance. It is also practical and cost effective to prepare one's own tools, particularly with arrows which are often replaced and have greater variations.

The current art in the industry relating to manual preparation and maintenance of archery tools, specifically fletching of arrow, offer components without easy means for attachment. Maintenance tools for these purposes comprise a variety of clamps and stands that have very little means for guided accuracy. For example, U.S. Pat. No. 2,286,574 provides a jig where an arrow can be fixedly positioned thereon whereby fletching is manually attached and held in place by a clamping tool, one piece at a time. This can be a slow and inaccurate process. U.S. Pat. No. 7,074,143 provides an alternative method for fletching an arrow by providing separate fletching and expandable adhesive sleeve. The fletching is manually and individually attached to a loose and wider sleeve portion, said sleeve portion then slide over an arrow shaft where the sleeve is heated to shrink. This process is fraught with inaccuracies. The invention provides no means for accurate adhesion of fletching to the sleeve. The heating and shrinking process is additionally unpredictable because the user's manner of heat application could vary. Given that the market is dominated by shrinkable fletching sleeves and tools for this type of maintenance, recent patents have focused around this manner of application. For example, U.S. Pat. No. 8,333,369 provides a clamping tool and method for attaching more than one fletch sleeve around more than one arrow shaft. The means of attachment still require a heating process with inconsistencies. For other types of non-sleeved fletching wraps, clamping tools are the only option. See, U.S. Pat. No. 8,286,953.

There currently is a great need in the art for a method and tool that allows for accurate, consistent and precise manual attachment of fletching to an arrow shaft, specifically avoiding the problems inherent with sleeve tapes and enabling accurate attachment of flat planar sheets of tape. In particular, a method and device which would enhance and refine the performance of the user by enabling consistent and precise fletching with variable options. A method and device that is adaptable for use with existing fletching and arrow components in the market other than shrinkable sleeve wraps.

BRIEF SUMMARY OF THE INVENTION

The invention herein relates to a device that enables improved precision, accuracy, and consistency for manual attachment of fletching to an arrow shaft. The invention provides a two-step process, each with its own handling tool, the combination of which provides a consistent end result for personalized and well-performing fletched arrow.

A first step of this invention comprising the attachment of fletch vane (also referable individually as a fletch or a vane) to a non-stick side of adhesive backed tape by manner of a clamp system that contains prepositioned guides (also may be referred to as a guided clamp). The guided clamp comprising a first and second portion. Both first and second portions having geometric shape with a defined length wherein the first portion is positioned above the second portion, the internal surface of the first portion facing downwards towards the second portion, said internal surface of the first portion being flat. Both first and second portions having a front and rear end. Both first and second portions being hingely and swivelly connected at their rear ends for rotation of said first portion above said second portion along the same planar axis (first portion rotating up and down above the second portion in a clamping fashion). Said front portion of at least one of either said first or section portions having one or more clamping means such that when said first portion is positioned overtop said second portion in flush manner, said one or more clamping means interconnect to hold said first and second portions in clamped position.

Said second portion having a guiding block positioned forward from the rear end. Said guiding block comprising a plurality of vertically positioned planar slats. Each planar slat positioned in parallel with another planar slat to form vertical apertures there between. There are preferably 3 vertical apertures formed from the plurality of planar slats. Each vertical aperture comprising a narrow well space wherein no more than a single vane may be held upright therein. While each vertical aperture may be formed by different combination of multiple planar slats, the preferred combination is as follows: Two planar slats interconnected in permanent manner with a defined sleeved space therebetween that forms a single vertical aperture. Alternatively, the vertical aperture may be formed by cutting into a block of solid material or alternatively by molding process. Each single vertical aperture forming a single well unit for receiving a single fletch vane. Three single well units further positioned in adjacent manner with defined space therebetween. The space between each single well unit would eventually comprise the space between each vane when positioned around the circumference of an arrow. The space between each single well unit may be fixedly defined and created by placement of washers there between. Alternatively, the space between each single well unit may be finely adjustable by threaded rod connection. The space between each vertical aperture on the guiding block defines the space between each vane when adhered to fletch tape. The spacing between the vanes are preferably evenly spaced apart in radial manner around the arrow upon final attachment. Further still, alternative embodiment may have the guide block be machined or molded with fixed spacing between each said aperture for a nonadjustable version of the device. Guiding blocks manufactured by this method in nonadjustable form may provide for multiple sized blocks to accommodate different sized vanes or arrow shaft dimensions. The particular type of fletch vane material that this invention is directed to comprise any type of flat arrow vane or fin that is already shaped for use and may comprise any variety of vane material to include without limitations plastic, paper, or animal feather. The length of said vane is preferably 2.0 inches in approximal length but may be greater or less than 2.0 inches for purposes of this invention.

Said second portion of the guided clamp further having an internal surface facing towards the internal surface of said first portion. Said guiding block positioned on the internal surface of said second portion towards the front end of the second portion. The top surface of the guiding block is even and flat. The internal surface of said first portion further having a sleeve portion wherein a piece of fletch tape may be sleeved therethrough and held evenly in place. The sleeve portion is intended to hold the fletch tape in place and in aligned position relative to the vanes held within guiding block. The sleeve portion may preferably comprise transparent material such as a thin sheet of clear durable plastic connected to the internal surface of the first portion near either its front or rear ends, or at both ends. The sleeve portion would be attached at its farthest corners or edges to the internal surface of the first portion but with a central opening that would allow a sheet of fletch tape to slide snugly through and be held therein in sleeved manner. The sleeve portion need not be transparent in color for purposes of holding a sheet of fletch tape therein. Transparency allows for easy visual alignment of the tape. However, ease in visual alignment may alternatively be accomplished by other means such as color code, symbols, or markings.

The overall dimension of the guiding block, as defined by the dimension of each vertical slat, is preferably 2.35 inches in length, 0.72 inches in depth, and 0.916 inches in width. The dimensions may be slightly greater or smaller to accommodate the particular sized vane to be attached to said fletch tape. Each vertical slat should further have a thickness of at least 0.05 inches for application with standard diameter arrows which ranges from 0.29 inches to 0.305 inches. The distance between each vertical aperture/single well unit of said guiding block being defined in part by the thickness of each vertical slat and any additional spacers therebetween. This distance is important because it defines the space between each vane once the vanes are adhered to the fletch tape. Arrows with wider diameter may require a wider distance between each vane for an even spread of vanes therearound.

The guiding block is positioned on the internal surface of said second portion either in parallel manner with sides of said first and second portions or at an angle away from parallel. An angled position of the guiding block allows for angled positioning of vanes when attached to the fletching tape. The degree of angle positioning of the vanes on the fletching tape will determine the degree of spiral effect radially around an arrow upon final attachment. The degree of spiral of the fletching may affect the level of spin of the arrow when it is launched from a bow. The preferred angle setting for this device may be anywhere between 1.0 degree and 3.0 degree from center. Center in this case being defined by the center point of the cross section of said second portion when it is aligned with the center point of the cross section of said guiding block, assuming both embody a rectangular shape. An alternative definition for center in this case would be where the linear positioning of the vanes are in parallel with the length of the fletch tape when attached.

The method of attaching arrow fletch to the non-adhesive side of fletch tape comprising the following steps. First, slide a sheet of single-side adhesive fletch tape through the sleeve portion of said first portion of the guided clamp. The non-adhesive side of said fletch tape facing outward and downward towards the second portion. Secondly, place individual fletch vanes into each individual vertical aperture of the guiding block, preferably three vanes for three separate vertical apertures. The rear edge of the vane that is to be attached to the fletch tape should be positioned upward and outward of the vertical aperture of the guiding block, protruding slightly outward. Lightly add liquid glue to the exposed rear edge of each said vane. Swivel the first portion downward towards the second portion such that the exposed surface of the fletch tape comes in direct contact with the rear edge of the vanes of each vertical aperture. Engage the clamping means at the front end of said first and second portion such that the two portions are in clamped position overtop each other. Allow the glue to set up to five minutes (or the recommended time as provided by the particular type of glue used) so that the glue is cured in place. Once the glue is cured, release the clamping means at the front end of the device. Rotate the first portion upward and away from the second portion such that the vanes in their attached position to the fletch tape are pulled out of the vertical apertures by motion of the first portion. By the first method of this invention utilizing the guided clamp as described herein, a unit of adhesive replacement fletching is produced. The guiding block may comprise any hard-durable material and preferably metal material to allow ease in removal of adhesive glue residue.

The second step of this invention comprises attaching the earlier prepared adhesive replacement fletching to an arrow shaft. This second step involves a separate tool, herein referred to as a rolling jig (may also be referred to as a rolling guide). The tool itself comprising a first horizontal portion positioned over top a second horizontal portion. Said first and second horizontal portions abutting a first and second vertical side portions. Said first and second vertical side portions each comprising a planar surface positioned in vertical manner. Said first horizontal portion being swivelly connected at its rear end to said first and second side portions. The front end of said first horizontal portion is free floating and not connected to any surface of the rolling guide device. The lower second horizontal portion is in positioned between the first and second side portions at a declining angle from its front end towards its rear end. The front end of said lower second horizontal portion may swivel upward towards a steeper angle relative to its rear end. The front end of the first horizontal portion rotatable downward to a point of abutment with the front end of the second horizontal portion such that the front end of the first horizontal portion is at a lower level than the rear end of the first horizontal portion at resting position. In lowered position, the front end of the second horizontal portion remains at an angle higher and above the horizontal line of its rear end. This is achievable by allowing the front end of the second portion to rest against a protrusion from either first or second vertical side portions which serves to stop the rotation of said second horizontal portion. Along the internal surface of the front edge of the first horizontal portion is a curved groove element that extends the length of the first horizontal portion. The groove element is positioned along proximate to the front edge of the first horizontal portion such that it would overlap and rest over the surface of an arrow shaft positioned within the rotatable guide. The curved grooved Said first vertical side portion of the rolling guide having a sleeving hole therethrough. The diameter of the sleeving hole being equal to or slightly greater than the diameter of an arrow shaft. The diameter may be sufficiently wide to accommodate the diameter of a variety of arrow shaft sizes given that some shafts may be slightly wider or narrower than others. The sleeving hole should not be too large beyond the diameter of an arrow shaft that the shaft would be too loosely positioned therein. Preferably, the diameter of the sleeving hole should not be beyond 50% greater than the diameter of the arrow shaft.

The second vertical side end of the rolling guide having a receiving hole directly across from to the receiving hole at aligned horizontal position. The receiving hole having an internal space and connection piece that firmly captures and holds onto the nock at the top end of an arrow. When in use, the arrow is sleeved through the sleeving hole and engaged firmly in place with the receiving hole, resting in straight horizontal position against the bottom surface of the two holes. A rotating means comprising rotating gear elements is attached to the second side portion in connection with the connection piece of the receiving hole. The rotating means is preferably a rotatable handle but may also comprise other embodiments and can be manually or electronically operated. As the rotating means is rotated, so would the arrow shaft that is engaged with the receiving hole.

The first and second horizontal portion further having a rectangular recess from their each front ends proximate to the second vertical side portion. The dimension of the rectangular recess being near similar to the length of an arrow vane and may be slightly greater or less but should accommodate the passing through of the taller end of said vane. A rotatable cushioned roller is seated within the rectangular recessed area of the first horizontal portion by an axle connection. The rotatable cushioned roller comprising a cylindrical shape wherein its length is in parallel position with the length of the first horizontal portion.

The method of attaching adhesive replacement fletching as provided above by laying the fletched tape with attached vanes thereon over top said second horizontal portion with the adhesive side facing upward and vane portions through said recessed area. Sliding an arrow shaft through the sleeving hole and connecting the nock end to the internal area of the receiving hole such that the arrow is fixedly connected to the rotating means and rotating handle. The lower second horizontal portion is lifted up towards the area such that the edge of the fletch tape adheres to the arrow shaft in aligned parallel manner to each other. Said second horizontal portion is released and lowered. The first horizontal portion is then lowered over top said arrow shaft such that the groove element along the length of the first horizontal portion curves around the arrow shaft. While placing some pressure overtop said first horizontal portion onto said arrow shaft, the rotating handle is rotated. By rotating said shaft against said top horizontal portion, the fletch tape is rolled onto the arrow shaft, whereby the vane pieces are pressed through in cushioned manner by said rolling cushion element. Said groove element may further be lined with soft material along its length to accommodate the curve of said arrow shaft for a softer contact on said shaft. Said soft material may comprise any of the following but not inclusively to felt, fabric, foam, etc. Upon complete adhesion of the replacement fletching onto the arrow shaft, the arrow may be removed and immediately used. Note that the length of the nock will determine where along the arrow shaft the replacement fletching (and ultimately the vanes) will be positioned along the arrow shaft. If the nock is longer, then the vanes will be located closer to the top end. If the nock is shorter, than the vanes will be further from the top end. As such, fixed distance options are feasible by offering several different lengths of nocks to attach onto the arrow shaft during this process in order to personalized vane positioning. The preferred nock lengths may be any of the following: 1) 0.75 inches, 2) 1.00 inches, and 3) 1.25 inches. The preferred standard length is 0.75 inches. This feature offers greater variable options with consistent results.

DESCRIPTION OF THE DRAWINGS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurement, dimension or particular construction material indicated herein are solely provided as examples of suitable configurations and are not intended to be limiting in any way. Depending on the needs of the particular application, those skilled in the art will readily recognize, in light of the following teachings, a multiplicity of suitable alternative implementation details.

Figure 1:
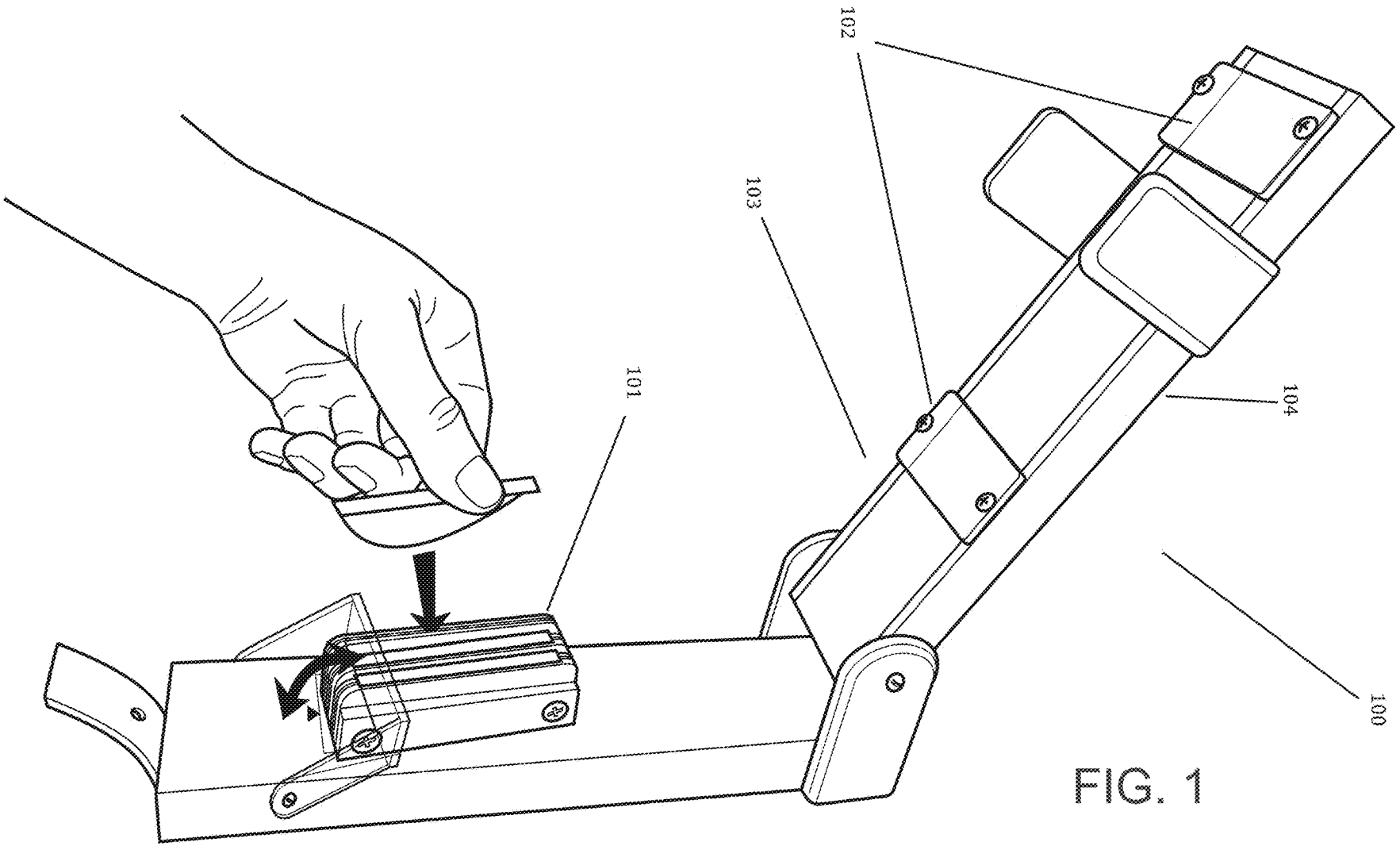
FIG. 1 provides an exemplary image of a front right side perspective view of the guided clamp according to a preferred embodiment of this invention.

FIG. 1 provides an illustration of a preferred embodiment of the guided clamp 100. The guided clamp 100 may comprise any solid, rigid, durable material, including without limitations wood, metal, plastic, or combinations thereof. The guiding block 101 is preferably comprised of metal material such as aluminum or steel to allow ease in cleaning and removal of cured glue residue thereon. The sleeve portion 102 that is provided on the internal surface 103 of the first portion 104 of the guided clamp 100 may comprise transparent plastic material for visual ease when adjusting the fletch tape held therein. Alternative embodiments of the sleeve portion 102 need not be transparent as long as it is designed with the primary purpose of holding the tape therein and in an aligned manner relative to the position of the vanes within the guiding block below. The sleeve portion 102 may additionally provide visual markings as a form of visual guide (not shown in the illustration) for ease in achieving visual alignment of the tape. True alignment of the tape would allow for the vanes to be attached thereon at a desired angle and position relative to the dimension and shape of the fletch tape. The visual markings may comprise a variety coding (color or symbol coding) which allows the tape to be aligned relative to the type or size of the vane held within the guiding block 101.

The guiding block 101 of the guided clamp may be angularly adjustable by rotating from a center platform (not shown in the illustrations), allowing the vanes to be attached to the fletch tape at preferred angles. The adjustable center platform may comprise a screw attached plate whereby the guiding block is connected thereon and swivelly adjustable. A visual guide such as an attached sticker or alternatively etched markings that show the angle of position of the guiding block can help enable the user to accurately adjust to a preferred angle of vane positioning.

Figure 2:
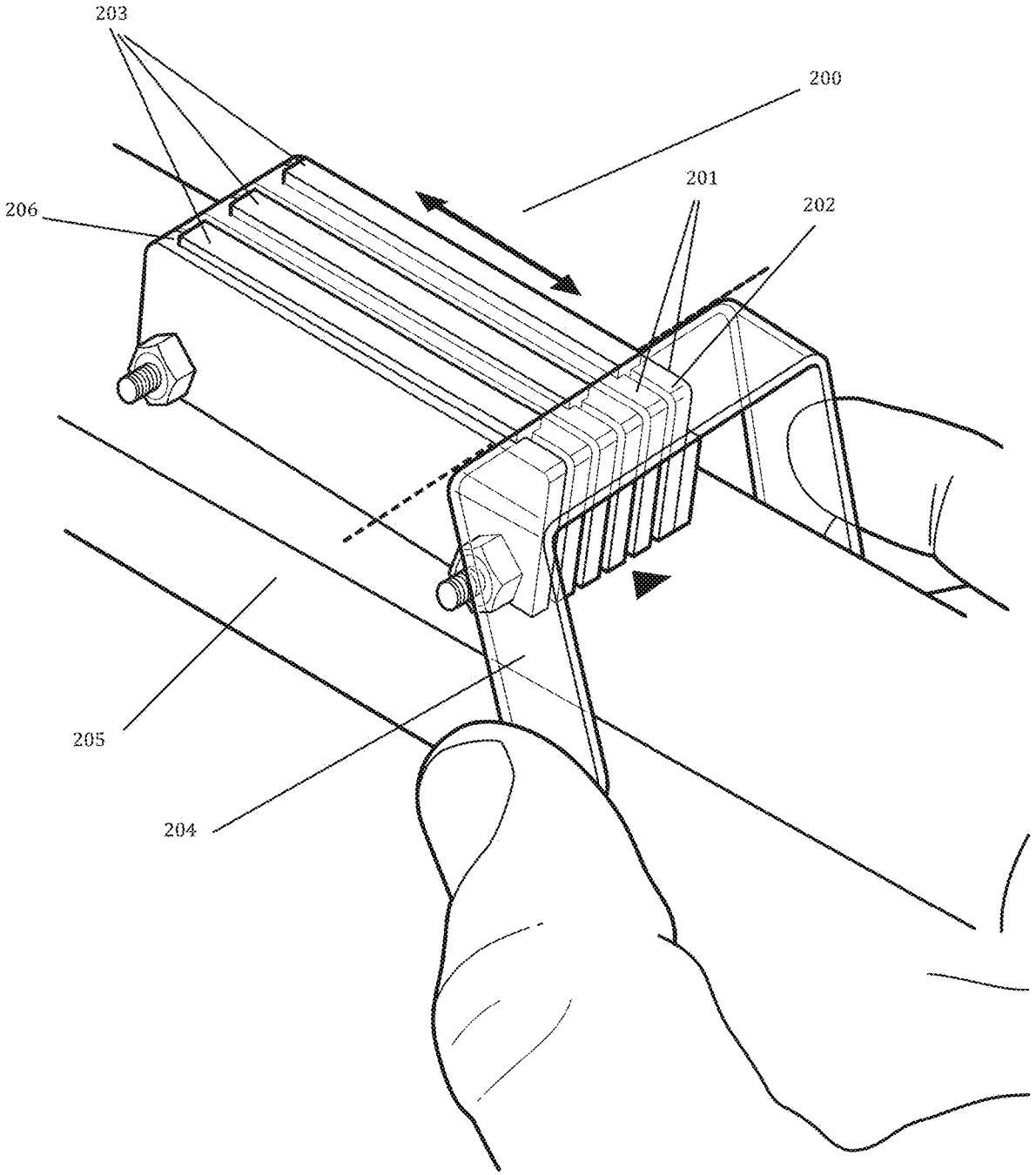
FIG. 2 provides an exemplary image of a front and left side perspective view of the guiding block and rotatable bar according to a preferred embodiment of this invention.

An adjustable version of the guiding block 200 according to FIG. 2 provides for multiple interconnected components that may be adjusted in position to accommodate different sized vanes or wider fletch tape for broader arrows. According to this preferred embodiment, two planar slats 201 are attached together in fixed manner such that a vertical aperture 202 of fixed dimension is provided. See FIG. 2. Each combination of two slats 201 and washer in connected form forming a vertical aperture 202, also referable as a single well unit. The dimension of the vertical aperture space 202 may be defined by a spacer device (i.e. a washer) placed between the two planar slats 201. The two planar slats 201 may be connected together with the spacer device therebetween by screw means, weld, or adhesive manner. Preferably three single well units 201, 202 (defined by two interconnected vertical slats forming a single vertical aperture) are positioned adjacently in parallel, separated by a spacing element. The spacing element may comprise, but is not limited to, one or more washer elements for adjustable distances therebetween. A preferred cross-sectional width spacing between each vertical aperture of each said single well unit among a plurality of single well units may be ⅛ inch. The cross-sectional width of each aperture is preferably 1 mm. The vertical aperture with spacing elements therebetween are removably fixed in position preferably by a screw and rod element. Each planar slat of each aperture unit 201, 202 need not comprise the same thickness and may be a combination of different thicknesses to achieve a particular spacing between the vanes. Each aperture unit capable of snugly hold a single vane 203.

Alternatively, the guiding block may be created from a single block of material by cutting or molding process for a simpler manufacturing process. By this method, the vertical apertures and spacing therebetween would be permanently positioned. As such, the guiding block of this more permanent embodiment may provide multiple size dimensions to accommodate different sized vanes or diameter arrow shafts.

An additional means for aligning the vanes within the guiding block 200 is contemplated by manner of a rotatable bar 204 attached to the second portion 205 of the guided clamp. By rotating the rotatable bar 204 upward at the initial stage of placing the vanes into each vertical aperture 202 (single well unit), the vanes 203 may be pushed upward against the rotatable bar 204 to be in even alignment relative to each other. The rotatable bar 204 may be rotated downward out of the way when the first portion of the clamp is to be lowered in position for clamping purposes. An alternative method of achieving the same purpose in case may be by a visual line or marking on the top surface 206 of the guiding block 200. This would avoid need of a rotatable bar 204 attachment.

Figure 4:
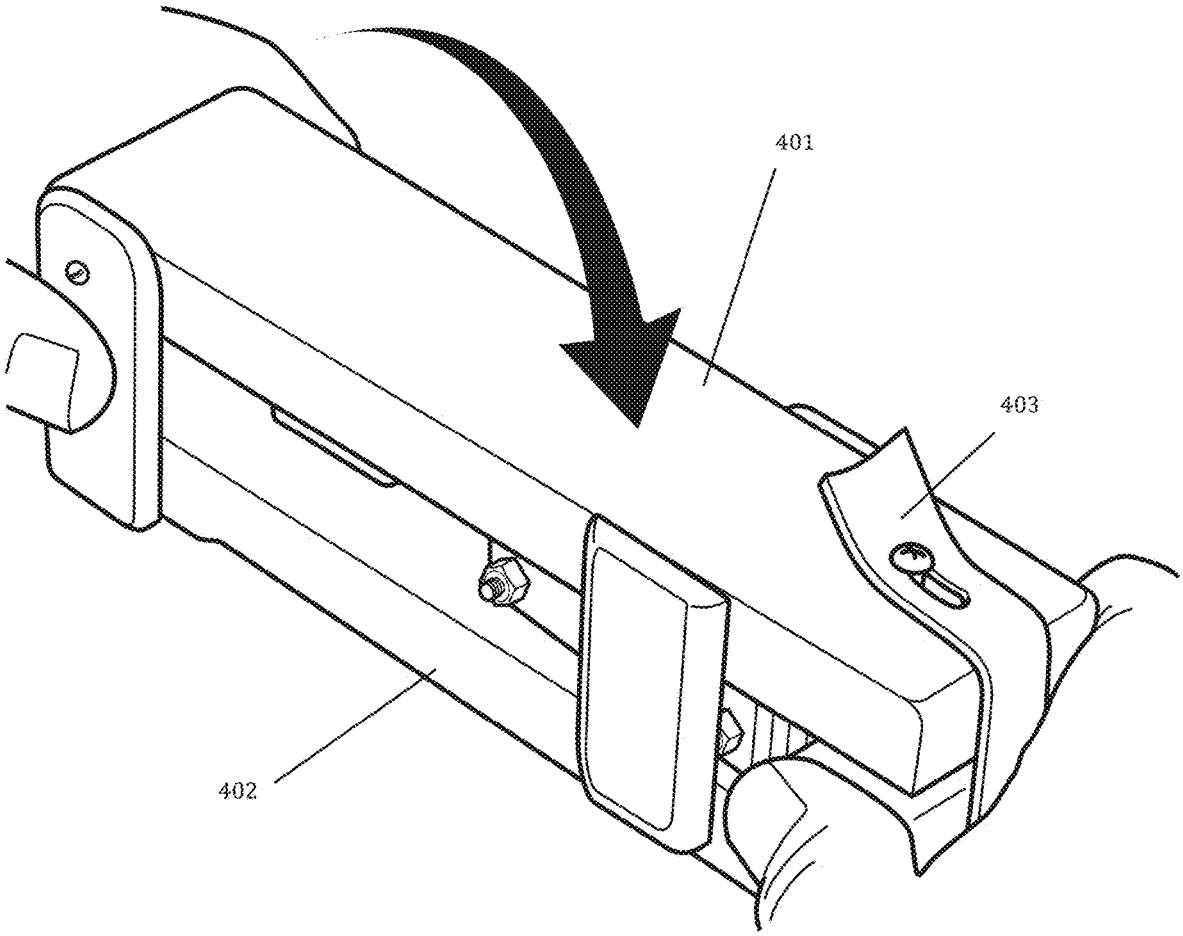
FIG. 4 provides an exemplary image of a front left side perspective view of the guided clamp according to a preferred embodiment of this invention.

When the vanes are ready to be attached to the fletch tape, the first portion 401 is lowered onto the second portion 402 such that the fletch tape would be in contact with the protruding portions of the vanes and adhered by glue. This part of the process essentially comprising a clamping effect of the fletch tape onto the vanes. As such, a means 403 for holding the first and second portions tightly together for an uninterrupted period of time is desired. The means for holding the first and second portions together in clamping position may be achieved by a strap element 403, or alternatively any known means including without limitations clips, hooks, bands, etc. FIG. 4 illustrates one example of a preferred means of connection.

Figure 3:
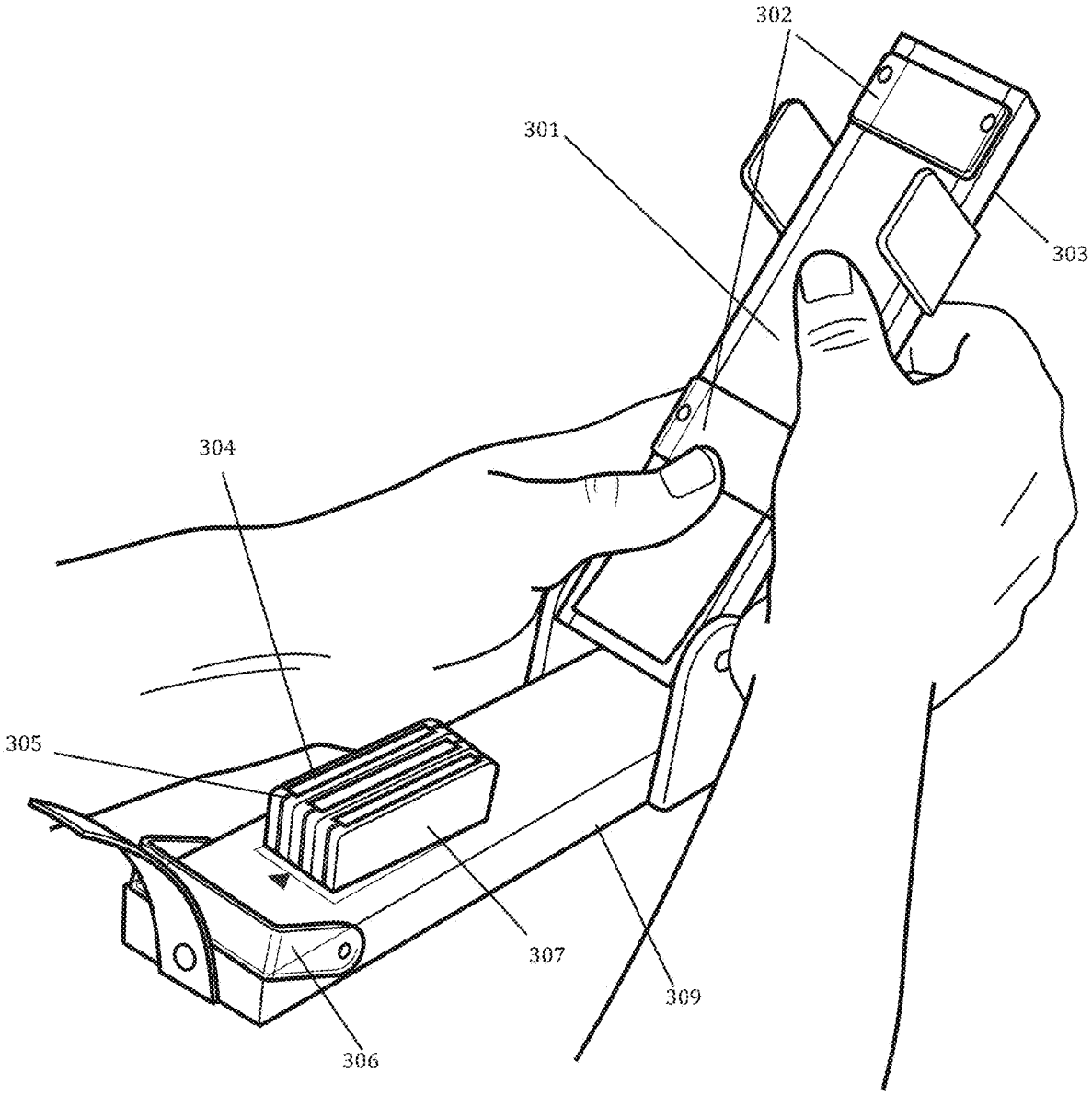
FIG. 3 provides an exemplary image of a front right side perspective view of the guided clamp according to a preferred embodiment of this invention.

Said method of attaching fletch vanes onto the surface of a planar sheet of fletch tape 301 comprising the following steps. See FIGS. 3 and 4. A piece of fletch tape 301 is sleeved through the sleeving means 302 of the first portion 303 of the guided clamp 300. At least one or more vanes 304 are placed into the open space of each vertical aperture 305. Said vanes 304 are adjusted to a preferred alignment by use of said rotatable guide piece 306 which is rotated upward against the guide block 307. Upon alignment, said guide piece 306 is rotated downward and away from obstruction. Adhesive glue is added to the protruding portion of said vanes. Said first portion 303, 401 is rotated downward such that said fletch tape is in contact with said vanes and adhesive. Said first portion 303, 401 and second portion 309, 402 are locked in clamped position by a clamping means 403 to ensure pressured contact between said fletching tape and said vanes.

Figure 5:
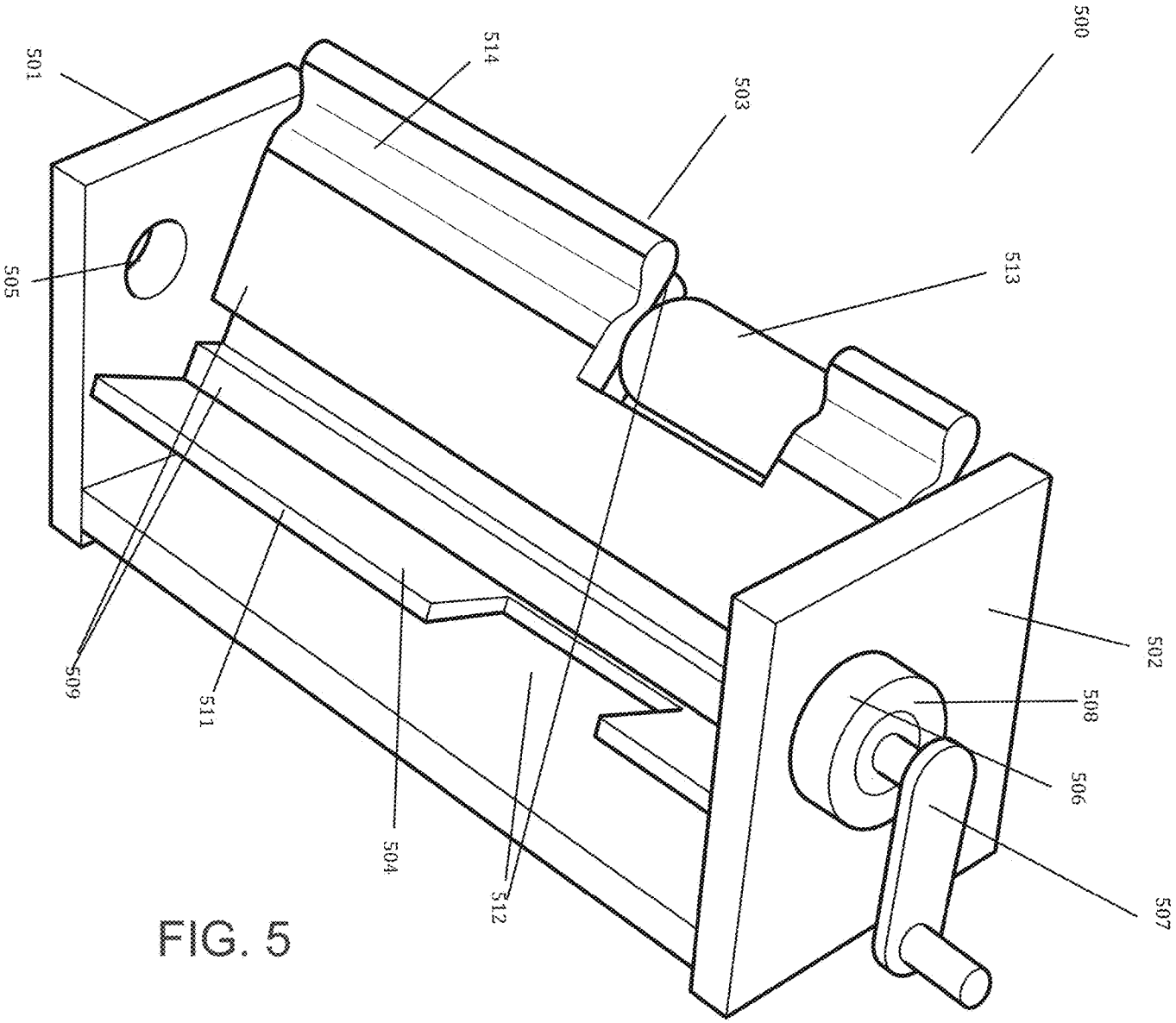
FIG. 5 provides an exemplary image of a front right side perspective view of a rolling guide according to a preferred embodiment of this invention.

FIG. 5 illustrates a preferred embodiment of the rolling guide 500. As with the guided clamp, the rolling guide 500 may comprise any hard and durable material, including but not limited to wood, plastic, metal, or any combination thereof. A first 501 and second 502 vertical portion are spaced apart and connected with a first 503 and second 504 horizontal portion. Said first vertical portion 501 having a sleeving hole 505 centrally along the top half of its surface to allow an arrow shaft to sleeve through and rest snuggly therein. Said second vertical portion 502 having a receiving hole 506 to receive the nock end of said arrow shaft. Said receiving end further connected to a rotating means 507 containing rotatable gear components attached to a rotating handle 508. Said rotating means may alternatively comprising gear components that are rotated by means of electrical signals initiated by button contact. The electrical signal may also be remotely initiated by radio or digital means. The nock end of an arrow shaft attaches and connects snugly to said receiving end and will be rotated by said handle and gear components.

Both said first 503 and second 504 horizontal portions are swivelly connected at their rear ends to said first 501 and second 502 vertical portion such that either said first 503 and second 504 horizontal portions may swivel upward and downward at their rear ends 509. A protrusion (not shown in the illustrations) which may comprise a dowel or stopper extends from said first 501 and second 502 vertical portions underneath the front end 511 of said second horizontal portion such that at resting position, the front end 511 of said second horizontal portion 504 is at an elevated position from its said rear end 509. Said second horizontal portion 504 essentially slanting at a downward angle from its front end 511 towards its rear end 509. Said first 503 and second 504 horizontal portions further having a recessed area 512 along its front ends 509 at the same location for purposes of accommodating the vanes that will pass through this recessed area 512 when rotated. Said recessed area 512 of said first horizontal portion 503 containing a cushioned roller 513. The cushioned roller portion 513 should preferably comprise a softer textured material much like rubber or durable foam with elastic response so as not to deform the shape of the vanes from pushing too hard against it during the rolling process. The first horizontal portion 503 having a groove 514 along the length of its internal surface that aligns with the location of where the arrow shaft should rest when said arrow shaft is sleeved through and resting against the sleeving hole 505 and receiving hole 506 of the first 501 and second 502 vertical portions. The groove 514 along the length of the first horizontal portion 503 being lined with a soft material such as but not limited to felt to softly cushion and guide the fletch tape as it is being pressed against the arrow shaft during the rolling action.

Figure 6:
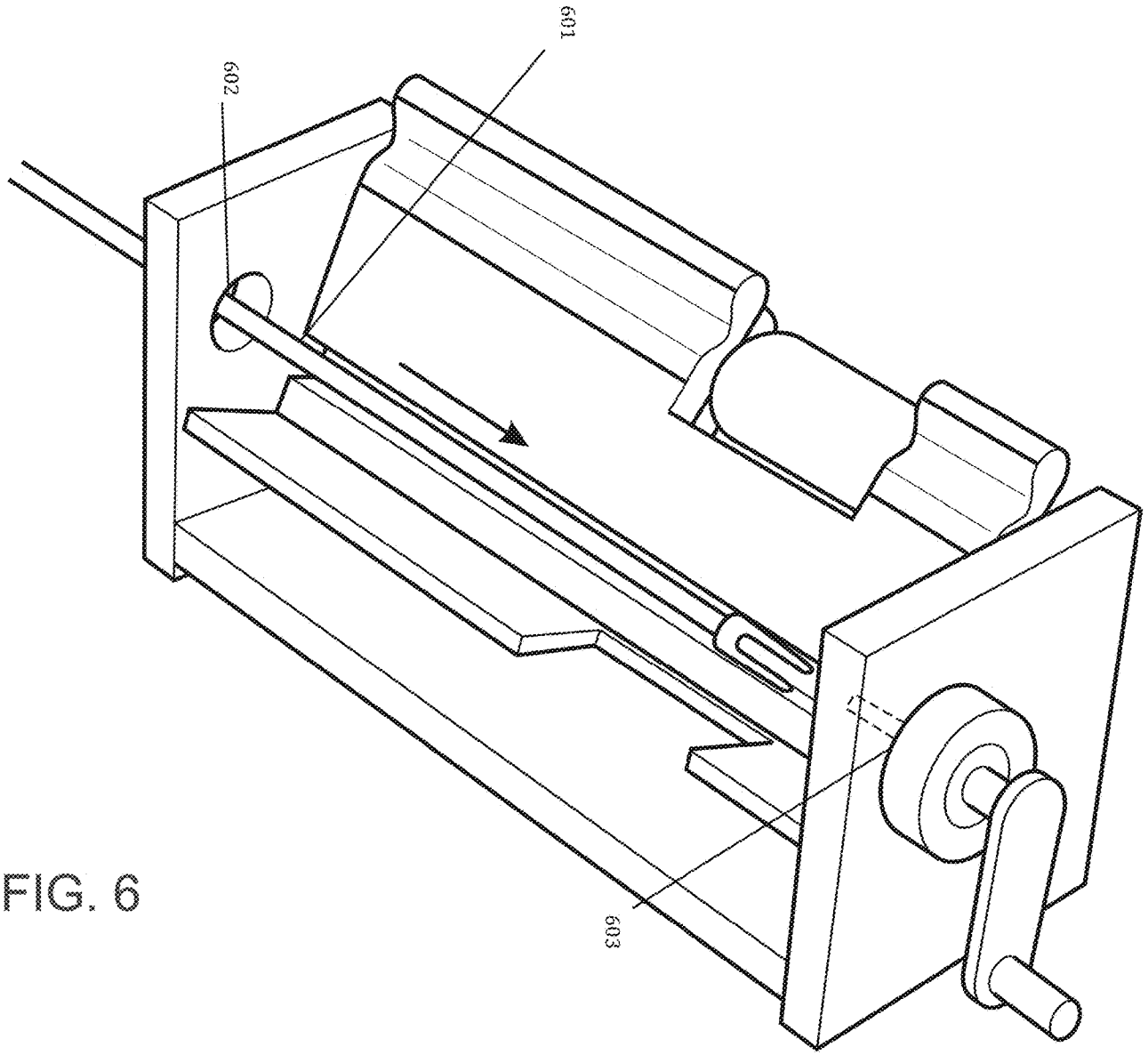
FIG. 6 provides an exemplary image of a front right side perspective view of a rolling guide according to a preferred embodiment of this invention.
Figure 7:
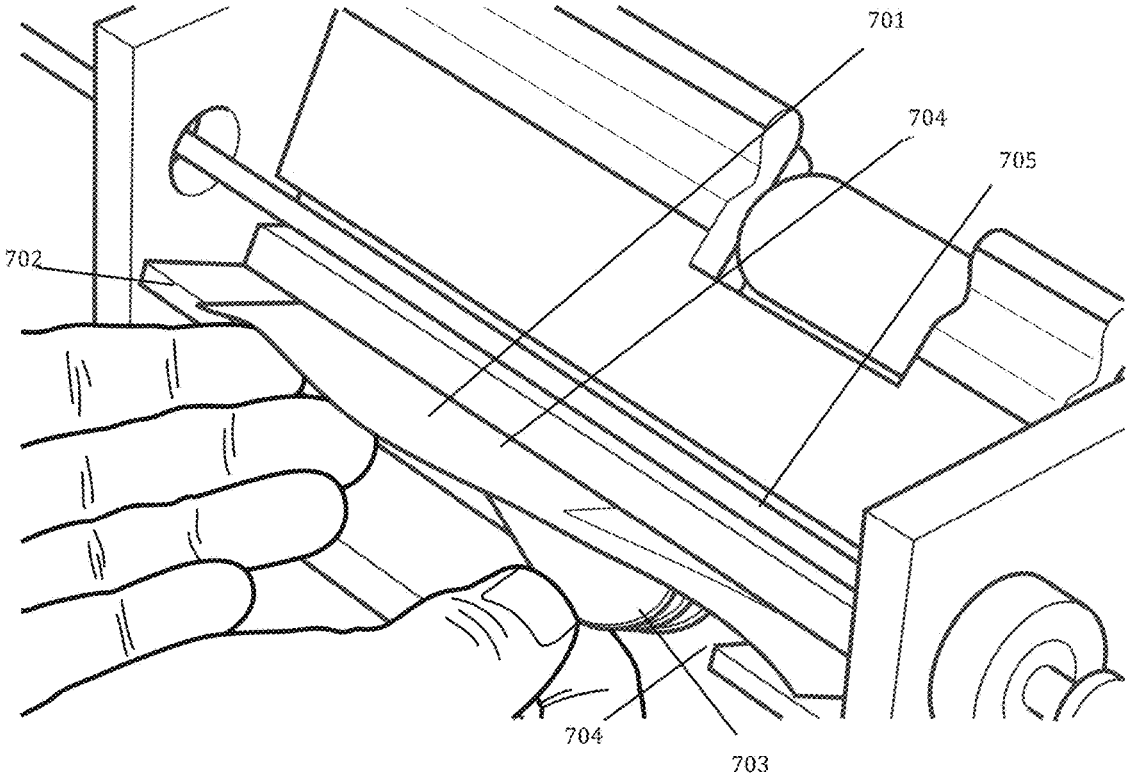
FIG. 7 provides an exemplary image of a front right side perspective view of a rolling guide according to a preferred embodiment of this invention.
Figure 8:
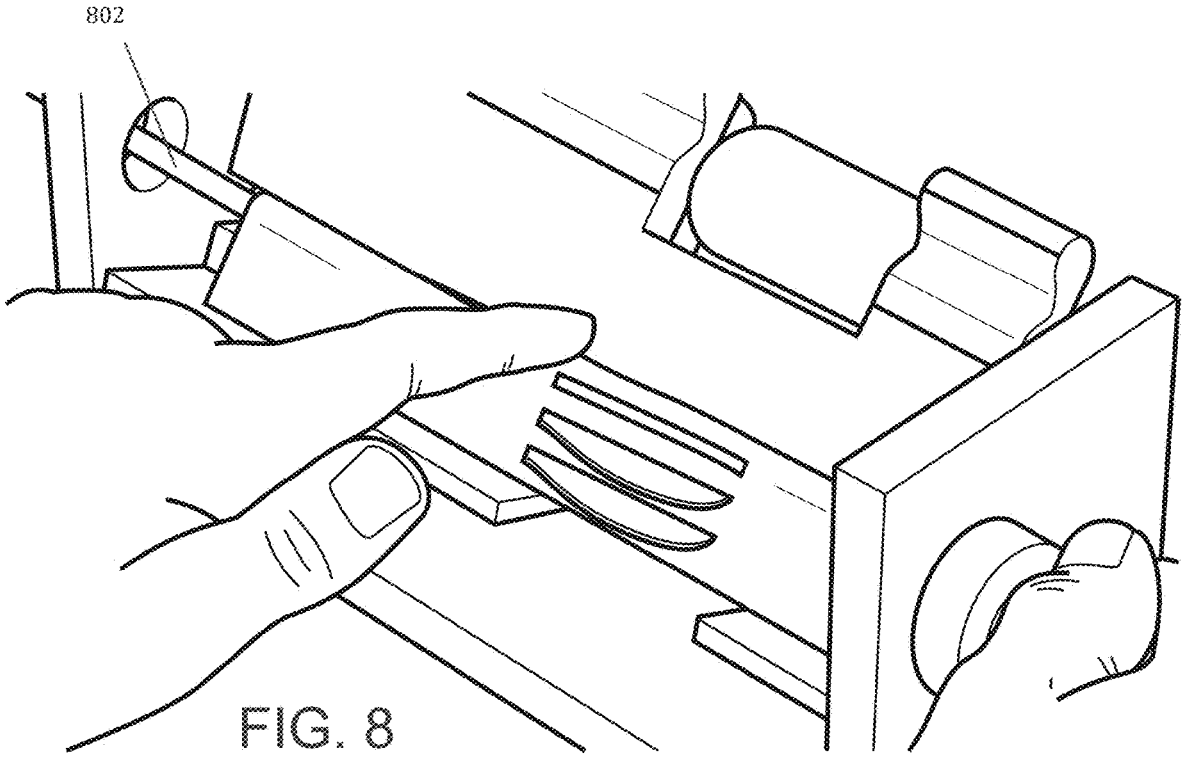
FIG. 8 provides an exemplary image of a front right side perspective view of a rolling guide according to a preferred embodiment of this invention.
Figure 9:
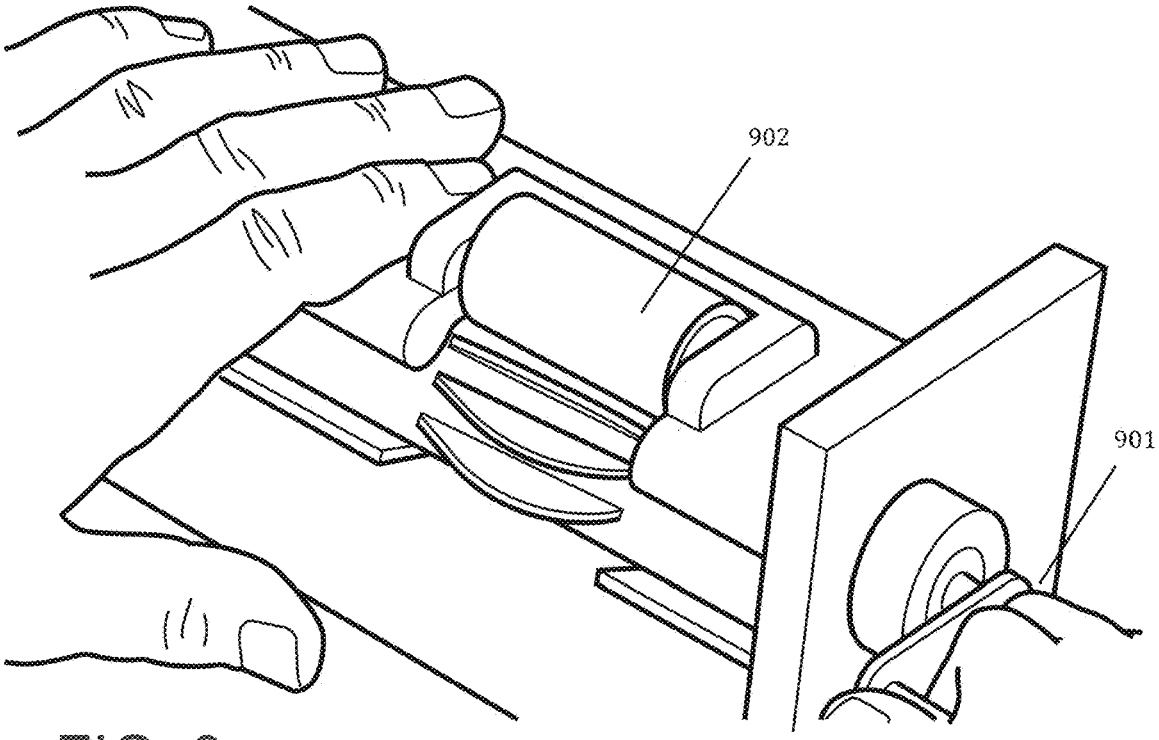
FIG. 9 provides an exemplary image of a front right side perspective view of a rolling guide according to a preferred embodiment of this invention.
Figure 10:
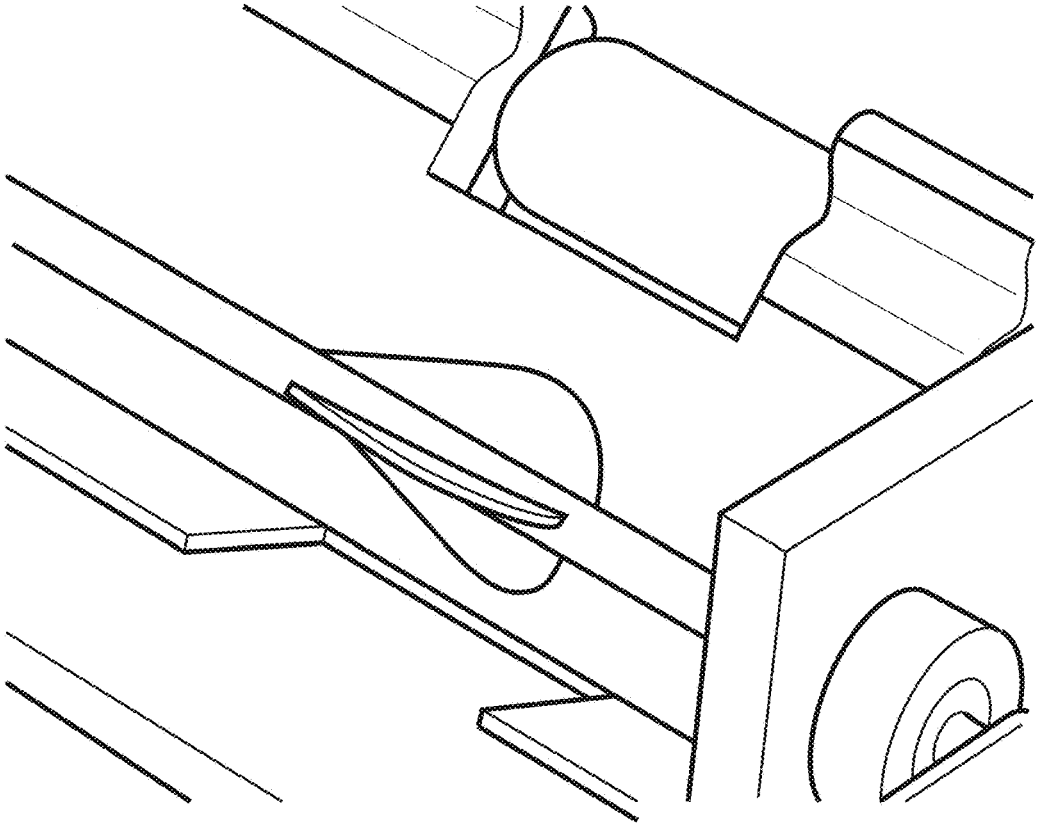
FIG. 10 provides an exemplary image of a front right side perspective view of a rolling guide according to a preferred embodiment of this invention.

A method of attaching a planar piece of fletching tape containing fletching vanes onto a bare arrow shaft comprising the following steps as shown in FIGS. 6 through 10. As shown in FIG. 6, an arrow shaft 601 is first sleeved through the sleeving hole 602 and in snug connection with said receiving hole 603. As shown in FIG. 7, said fletch tape 701 is positioned onto the top surface of said second horizontal portion 702 with the vanes 703 facing downward through said recessed area 704 and the adhesive surface 705 facing upward towards said arrow shaft 705. As shown in FIG. 8, said second horizontal portion is swiveled upward towards said arrow shaft 802 to make adhesive contact with said arrow shaft 802. Said second horizontal portion is then lowered to its resting position. As shown in FIG. 9, said first horizontal portion is lowered onto said arrow shaft and said rotatable handle 901 is rotated, causing said fletch tape and vane to roll onto said arrow shaft with the aid of light pressure from the rolling guide 902. Upon completion, said arrow shaft is pulled away from said sleeving hole and receiving hole for immediate use as shown in FIG. 10.

Figure 11:
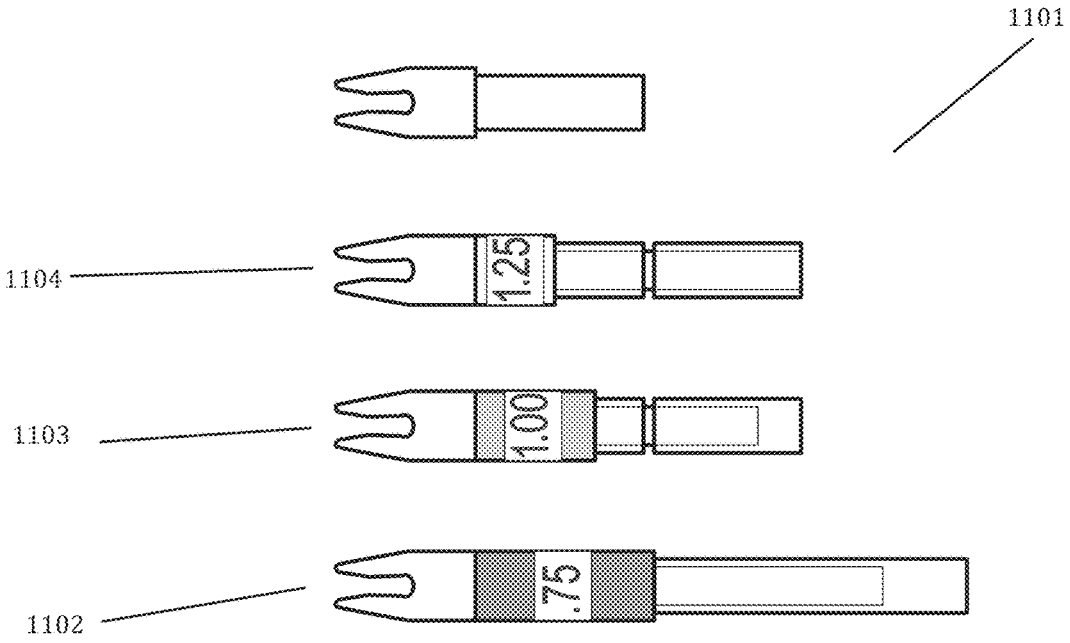
FIG. 11 provides an exemplary image of knock spacer elements according to a preferred embodiment of this invention.
Figure 12:
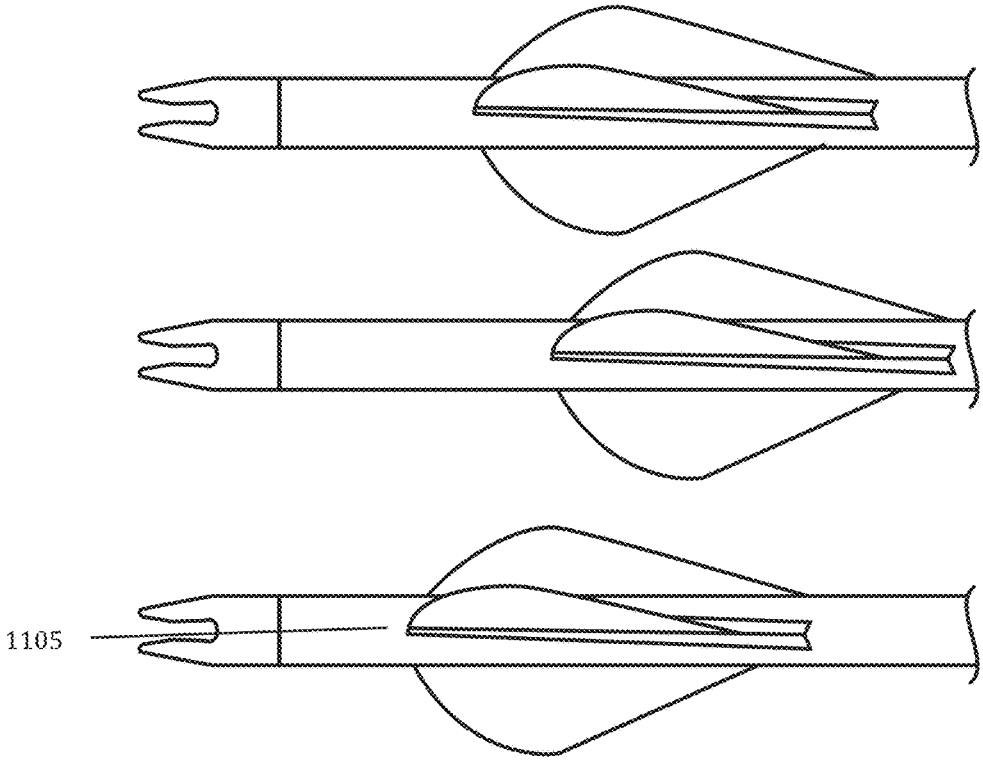
FIG. 12 provides an exemplary image of vane elements in attached form according to a preferred embodiment of this invention.

A further alternative embodiment of this invention provides for optional means to adjust the placement of said fletched tape onto the top end of the arrow. As described above herein, the distance of attachment from the nock end of the arrow shaft may be achieved by positioning the arrow shaft either closer or further away from the receiving hole of the second vertical portion of the rolling guide device. Adjustment of distance from the receiving hole may be achieved by temporary use of different sized nock elements (may alternatively be referred to also as "space adapters"). See FIG. 11. Preferable lengths of the space adapters 1101 may comprise any or all of the following options: 0.75 inch 1102, 1.00 inch 1103 and 1.25 inches 1104. The longer the spacer adapter 1104, the closer the fletching vanes 1105 will be attached to the arrow tip at the nock end.

Note that the above described means for varying locational placement of fletched tape to arrow shaft may also be maintained in consistent manner throughout the entire fletch preparation and fletch adhering process of this invention by means of color code or symbol code. For example, four separate colors may be assigned to each sized nock spacer which would be coordinated with the color of the fletch tape. The color would serve as an indicator of the desired and intended manner of fletching. Visual coding may further serve to maintain consistency between the fletch preparation and fletch adhering processes with regards to different sized vanes or different diameter arrow shafts. For example, in the case of nonadjustable guiding blocks, each block may have an associated symbolic code (color, number, etc.) which would be coordinated with a particular type of vane and fletch tape. By matching the symbolic codes between the various tools and components, the fletched tape would properly wrap around a particular sized arrow shaft to the preferred parameters.

It should further be contemplated that both clamping guide and rolling guide may comprise removably attachable components such that the device may be collapsible for greater ease in storage or packaging.

Other features, advantages, and object of the present invention will become more apparent and be more readily understood from the following detailed description, which should be read in conjunction with the accompanying drawings.

The invention claimed is:

1. An arrow fletching system comprising a guided clamp and a rolling guide, said guided clamp comprising a guiding block with one or more vertically positioned internal apertures, said guided clamp further having a first portion with an internal surface, the internal surface of said first portion being pressable against said guiding block, said rolling guide comprising a first and second vertical portion, said first vertical portion having a sleeving hole directly facing a receiving hole on said second vertical portion, said receiving hole having rotatable means, said rolling guide further having a rotatable cushioned roller horizontally positioned along a first horizontal portion, said first horizontal portion being adjustable along a vertical axis.

2. Said arrow fletching system of claim 1 wherein the internal surface of the first portion of said guided clamp further having a sleeve portion such that a piece of tape may be sleeved therethrough and held in place.

3. Said arrow fletching system of claim 1 where said guiding block is angularly adjustable.

4. Said arrow fletching system of claim 1 wherein said rolling guide having a first horizontal portion positioned below a second horizontal portion, said first and second horizontal portions connected to a first and second vertical portions, said first vertical portion having a sleeving hole and said second vertical portion having receiving hole, wherein said receiving hole of said second vertical portion is connected to a rotating mechanism.

5. Said arrow fletching system of claim 1 wherein one or more size of vanes are attachable to one or more size of fletch tape by manner of using said guided clamp.

6. Said arrow fletching system of claim 5 wherein said one or more size of vanes attachable to one or more size of fletch tape by manner of using said guided clamp is further attachable to one or more sized diameter arrow shafts by manner of using said rolling guide.

7. Said arrow fletching system of claim 1 wherein the location along an arrow shaft for attaching a vane attached fletch tape is adjustable by use of one or more nock attachments, each nock attachment having a different length, each nock attachment attachable to the end of an arrow shaft and further connectable to said rotatable means of said rolling guide to adjust the distance of the arrow shaft away from the second vertical portion.

8. Said arrow fletching system of claim 1 wherein the space between each aperture within said guiding block is adjustable.

9. A method of fletching arrows with an arrow fletching system of claim 1 according to the following steps:

a) place one or more vanes within the internal aperture of the guide block of the guided clamp with a portion of the vane protruding there above the guiding block, b) place a sheet of fletch tape onto the guided clamp, c) add liquid adhesive over the protruding portion of the vane above the guiding block, d) press the internal surface of said first portion of said guided clamp overtop said guiding block such that said fletch tape is in direct pressured contact with the protruding portions of said vanes until the liquid adhesive there between cures, e) release said first portion from said guiding block and remove the vane attached fletch tape from said guided clamp.

10. A method of fletching arrows with an arrow fletching system according to claim 9 by further following the additional steps:

a) attaching a nock element to the end of an arrow shaft, b) suspending said arrow shaft in place between the sleeving hole and the receiving hole of the rolling guide such that the nock element is in communication with the rotatable means of the rolling guide, c) evenly adhere the edge of the adhesive side of said vane attached fletch tape along the length of said arrow shaft and within the recessed area of the second horizontal portion locatable below said suspended arrow shaft, d) lower said first horizontal portion overtop said arrow shaft such that said rotatable cushioned roller is in direct contact with said vanes of said vane attached fletch tape, e) rotate said rotatable means of said second vertical portion of said rolling guide such that said the internal surface of said first horizontal portion presses said fletch tape against said arrow shaft and said rotatable cushioned roller softly presses against said vanes of said vane attached fletch tape.

* * * * *